United States Patent [19]

Zveibil

[11] Patent Number: 4,641,700

[45] Date of Patent: Feb. 10, 1987

[54] CURTAIN OF WINDABLE OSCILLATING BLADES

[76] Inventor: Salvador M. Zveibil, 65 Uranium Street, Sao Paulo, Brazil, 04637

[21] Appl. No.: 581,330

[22] Filed: Feb. 17, 1984

[30] Foreign Application Priority Data

Apr. 15, 1983 [BR] Brazil ..... PI8302030

[51] Int. Cl.[4] ..... E06B 9/08

[52] U.S. Cl. ..... 160/133; 160/166 A

[58] Field of Search ..... 160/166 A, 196 R, 196 D, 160/197, 133

[56] References Cited

U.S. PATENT DOCUMENTS

| | | | |
|---|---|---|---|
| 1,557,058 | 10/1925 | Johansen | 160/196 D |
| 1,649,943 | 11/1927 | Boeck | 160/196 D |
| 2,100,976 | 11/1937 | Norton | 160/196 D |
| 2,207,420 | 7/1940 | Thomas | 160/166 A |
| 2,370,794 | 3/1945 | Houmere | 160/196 X |
| 2,524,373 | 10/1950 | Bopp et al. | 160/166 A |
| 2,604,160 | 7/1952 | Kolterman | 160/166 A |
| 2,605,825 | 8/1952 | Armstrong | 160/166 A |
| 2,636,556 | 4/1953 | Light et al. | 160/166 A |

*Primary Examiner*—J. Franklin Foss
*Assistant Examiner*—David M. Purol
*Attorney, Agent, or Firm*—Darby & Darby

[57] ABSTRACT

A windable curtain or blind in which individual bands are wound or unwound on a winding tube. A torpedo device including first and second driving screws acts to reduce input rotational motion resulting from motion of a manual belt. When the belt is fully unwound the individual bands are rotated by means of a rack coupled to the second driven screw to control lighting and ventilation.

3 Claims, 8 Drawing Figures

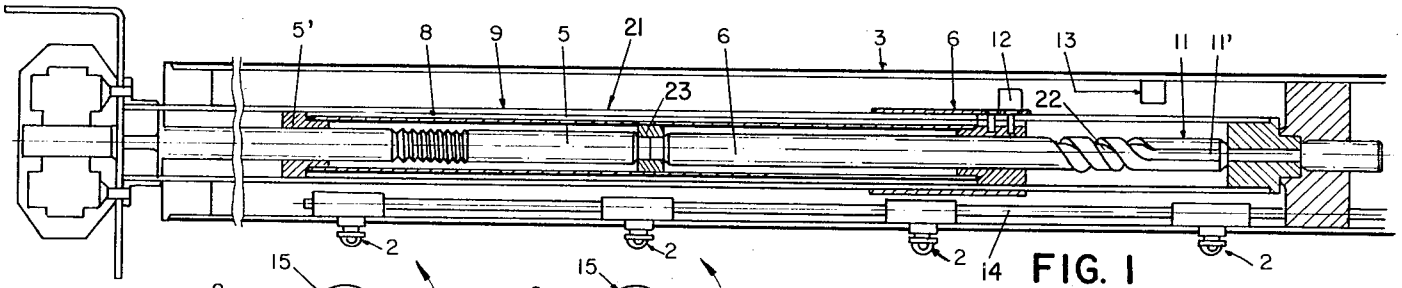
FIG. 1
FIG. 2
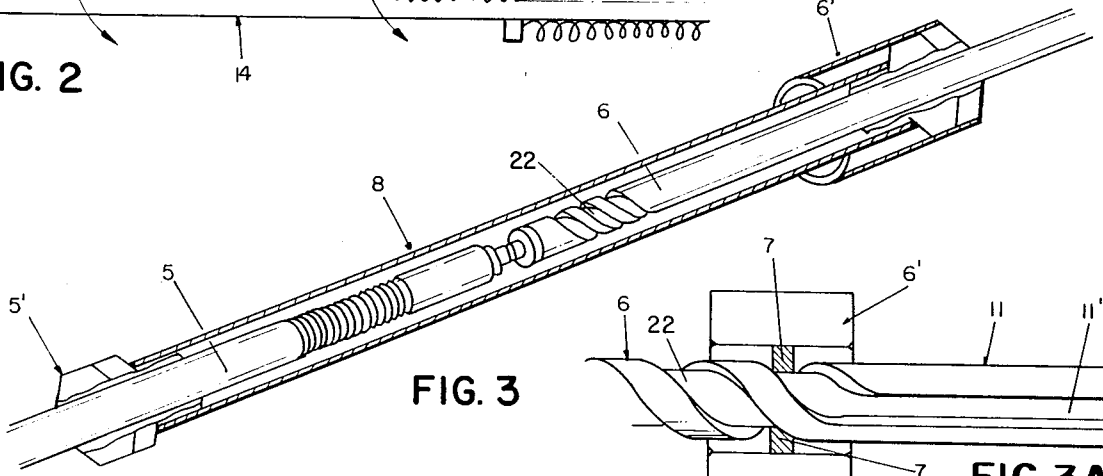
FIG. 3
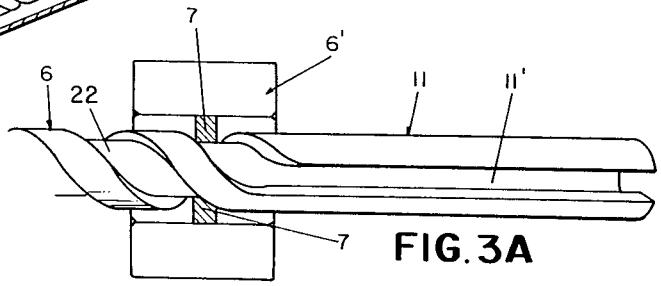
FIG. 3A

FIG. 4
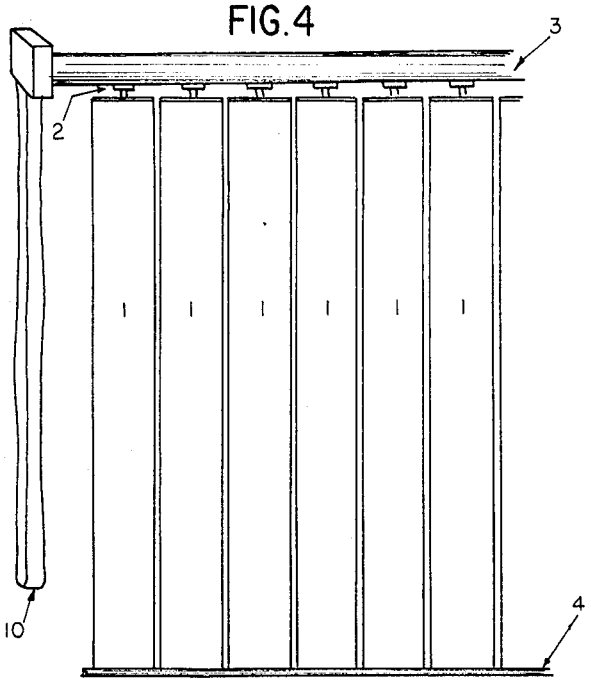
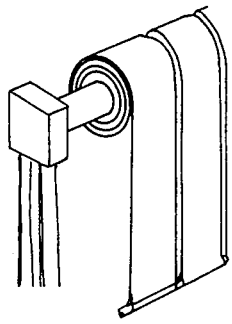
FIG. 4A
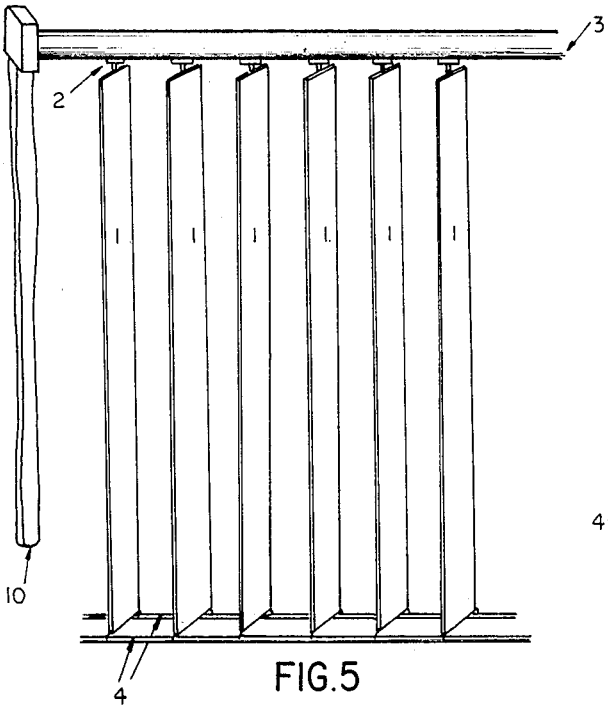
FIG. 5
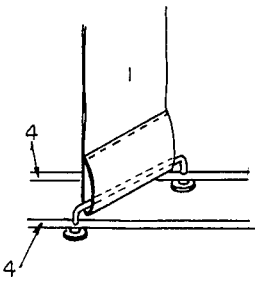
FIG. 5A

CURTAIN OF WINDABLE OSCILLATING BLADES

The present invention relates to a curtain or blind which may be used in a window. The device includes a curtain containing parallel or rotating blades, strips or bands of windable material such as cloths, mats and other similar products, the bands being fixed or hanging by means of hanger-like hooks, on a winding cylinder or tube. A dual motion is imparted to the bands such that they are wound or unwound on the winding cylinder and then rotated. The rotation of each band is coordinated at the winding ends by one or two rigid or semi-rigid parallels having the shape of rules that can articulate freely in a parallelogram form through a wide angle that permits the rotational movement of the blades for the purpose of shade and ventillation.

DESCRIPTION OF THE DRAWINGS

FIG. 1 is a schematic front view, shown in section, of the mechanism that drives the curtain, also showing the winding cylinder, the hangers, the differential screw mechanism, the driven screw and respective nuts, the nut carrier, the guide-channel, the rectilinear segment of the driven screw and respective rectilinear channel and stops;

FIG. 2 schematically shows a top view of the rack mechanism and respective gears of the hanger shafts;

FIG. 3 is a schematic perspective of the nut carrier;

FIG. 3A is a detail of the driven screw indicating the pins of the driven nut about to penetrate into rectilinear segment of the channel;

FIG. 4 is a schematic perspective of the curtain shown as operated by means of a belt, with the curtain unwound and the bands in closed position;

FIG. 4A is a fragmentary detail of a partly wound curtain;

FIG. 5 is the schematic perspective of the unwound curtain, with bands in partial rotation; and FIG. 5A is a detail of how the bands are fixed to the parallels.

DESCRIPTION OF THE PREFERRED EMBODIMENT

The curtain according to the present invention comprises means for rotating hooks 2 on a winding cylinder 3. The curtain is formed of bands which are coordinated on their windable end by means of parallels 4 that take the shape of rules, which articulate freely in a parallelgram form.

The winding cylinder 3 is controlled by a differential screw 21 mechanism 21, consisting of two differential coaxially positioned screws 5 and 6. First screw 5 of fast movement, and a driven screw 6 of slow movement, respectively coact with free nuts 5' and 6' of concordant movement. The nuts are interconnected by a carrier 8. that runs in the same longitudinal-coaxial direction as differential screws 5 and 6.

The driven screw 6 includes a helical track 22, rectilinear portion 11 and final track with a channel 11', the track stopping by the action of pins 7 mounted on the driven nut 6'. Winding of cylinder 3 also stops at optimum points where the bands come into combined rotation via hooks 2, when the curtain is totally unwound from winding cylinder 3.

Referring to FIGS. 2 and 3, the hooks or hangers associated with the winding cylinder are commanded by a rotational device that has rods or racks, said device being driven by a new mechanism of differential screws, here denominated a differential screw mechanism which includes a nut carrier 8.

Differential screw mechanism 21 is a rotational reducer consisting of two differential screws positioned in a coaxial manner. One of the screws is a slow driven screw 5 and the other a fast driven screw 6, respectively. Nut 5' is a standard nut. The driven nut 6' moves one or more travelling cylindrical pins 7 on screw channels which pins 7 slide in channels 22 and 11.

These nuts are interconnected at a convenient distance, by means of nut carrier 8 running lengthwise in a guide-channel 9 in the same longitudinal-coaxial way as the differential screws in such manner that when screw 5 turns, due to the action of a manual belt 10, crank or pulley, the driven screw 6 receives an impulse through the and and nut carrier assembly 8, nut 6' comes into slow rotation in inverse proportion to the number of screw threads per inch. As will be realized, in order for screws 5 and 6 to rotate independently, they must be freely rotatable at bearing 23.

This mechanism is noiseless and interlocking and also a reducer of stress or speed as required, according to the screw threads chosen.

Thus, the screw 5 can be quickly driven, transferring to the driven screw 6 and in turn to the winding cylinder 3 a powerful and slow rotation which is utilized to wind the bands of the curtain, a canopy or any other kind of covering in an attractive manner.

In addition to reducing rotational speed differential screw mechanism 21 noiselessly and positively locks in any place.

Another significant highlight this invention presents is the fact that the driven screw has, in its course and in its final track a non-coiled rectilinear segment 11 able to stop the rotation of the winding cylinder or tube 3 when the curtain is fully unwound.

This rectilinear segment, starting from the stop point in cooperation with screw carrier 8, pushes a rack, which in turn turns the hangers 2 of the bands 1 of the curtain. These bands 1, by means of a parallel mechanism 4 rotate through an optimum angle, from total closing to total opening on both sides or directions.

These stop points are selected to be the ideal points where the winding of the bands of the curtain ends, forcing the curtain bands to rotate in a joint effort.

This is because the pins 7 of the driven nut 6 penetrate into the notch or channel 11 of the non-coiled rectilineal track 11 at the precise moment of opening of the curtain, that is when the curtain is unwound. At this time the driven nut 6' travels on a straight line and pushes its stop 12 against stop 13 which is on the rack. Rack 14 is in turn driven and consequently drives gears 15 which are coupled to the shafts of the hangers 2, and force the bands 1 of the curtain to go into rotation.

I claim:

1. Curtain of windable, rotatable blades comprising:

driving means for receiving rotational motion;

winding cylinder means rotatable about a longitudinal axis thereof;

reducing means coupled to said winding cylinder means and said driving means for reducing said rotational motion and applying a reduced rotational motion to said winding cylinder, comprising first and second differential, screws, located coaxially, coacting with first and second free nuts, respectively, said first screw being coupled to said driving means so as to transfer its rotation thereto, and said second screw being coupled to said winding means, said screws having helical thread channels of different pitch conforming with respective threads of said nuts, said nuts being interconnected at a distance by a nut carrier mounted for linear motion coaxial with said screws and in such a manner that when said first screw turns said second screw comes into rotation, said thread channel pitches of said screws being selected so that fast rotations of said first screw are reduced when said second screw is rotated.

2. The curtain according to claim 1 further comprising:

a pin mounted on an interior of said second driven nut so as to extend into said second screw thread, said second screw thread further including a rectilinear channel in communication with said second screw helical channel;

rack means;

a first stop mounted on said rack means;

a second stop mounted on said second driven nut and positioned to push against said first stop when said pin engages said rectilinear channel, thereby moving said rack; and said hooks including gears engaging with said rack, whereby movement of said rack produces rotation of said hooks.

3. In a shade assembly of the type including a winding cylinder mounted for rotation about a longitudinal axis thereof, a plurality of bands, each mounted for rotation about a different axis generally perpendicular to said longitudinal axis, said bands being windable upon said winding cylinder upon rotation thereof, and means for providing a rotational force to said bands, the improvement comprising:

shaft means coupled to produce rotation of said winding cylinder upon being rotated and having a channel formed therein and a first and second end, said channel including a helically threaded portion starting beyond said first end and a rectilinear portion extending substantially axially along said shaft from said threaded portion towards the second end of said shaft;

driven means controllably moveable along said shaft and including a pin extending into said shaft channel; and means positioned to be engaged by said driven means when said pin is in said rectilinear portion of said shaft channel and said bands are fully unwound from said shaft for coupling the further movement of said driven means towards said second end to said means for providing a rotational force to said bands;

the movement of said driven means pin within the threaded portion of said channel producing rotation of said winding cylinder to wind and unwind said bands about the same, said rotation ceasing upon the entry of said pin into said rectilinear portion, the movement of said pin within the rectilinear portion producing rotational positioning of said bands, whereby the winding of said bands and the rotation thereof may be achieved with a single driving means.

* * * * *